United States Patent [19]

Yeu

[11] Patent Number: 4,778,432

[45] Date of Patent: Oct. 18, 1988

[54] DRUM BOY

[75] Inventor: Nam J. Yeu, Seoul, Rep. of Korea

[73] Assignee: Michael & Park's Trading and Sales, Inc., Honolulu, Hi.

[21] Appl. No.: 47,279

[22] Filed: May 8, 1987

[51] Int. Cl.[4] ..... A63H 03/28; A63H 13/00

[52] U.S. Cl. ..... 446/300; 446/336; 446/354

[58] Field of Search ..... 446/297, 298, 300, 303, 446/352, 353, 354, 409, 411, 414

[56] References Cited

U.S. PATENT DOCUMENTS

| | | | |
|---|---|---|---|
| 4,545,775 | 10/1985 | Kim | 446/297 |
| 4,676,764 | 6/1987 | Yeu | 446/298 |

FOREIGN PATENT DOCUMENTS

| | | | |
|---|---|---|---|
| 2446658 | 1/1980 | France | 446/298 |
| 1585715 | 3/1981 | United Kingdom | 446/303 |
| 2063691 | 6/1981 | United Kingdom | 446/300 |

*Primary Examiner*—Robert A. Hafer
*Assistant Examiner*—Michael Brown
*Attorney, Agent, or Firm*—George W. T. Loo

[57] ABSTRACT

A doll of a person with a drum who alternately appears to be beating the drum with his left and right hands while his head rotates left and right and a melody is playing. The doll includes a head portion, a torso portion, a limbs portion, a drum portion, a base portion, means to alternately raise and lower the hands in sequence and to alternately rotate the head left and right, and a melody module. The head portion includes a head which resembles a human and a drive pin. The torso portion is hollow and resembles the body of a human. The limbs portion resembles a human and includes a right arm, a right hand, a left arm, a left hand, a right leg, and a left leg. The drum portion includes a drum with a seat at its rear. The base portion includes a housing with feet on its bottom. The means to alternately raise and lower the hands in sequence and to alternately rotate the head left and right include a motor, two spaced cams, two spaced lefters, two spaced push rods, two spaced arm assembles, a head swivel assembly, gearing which transmits the motion of the motor to the cams, and wiring connecting the motor and melody module to a power source. The cams rotate at 180 degrees out of phase with each other. The lifters are operatively located above the cams and the push rods are operatively located above the lifters. Each of the arm assemblies is operatively connected to one of the push rods. The head swivel assembly is operatively connected to the arm assemblies.

5 Claims, 3 Drawing Sheets

DRUM BOY

BACKGROUND OF THE INVENTION

1. Field of the Invention

This invention relates to a doll of a person with a drum.

2. Description of the Prior Art

Present dolls of a person with a drum are not lifelike as they do not move. My invention is a doll of a person with a drum that is lifelike because the hands appear to be alternately beating the drum while the head rotates left and right.

3. Disclosure Statement

I am not aware of any doll of a person with a drum where the hands appears to be alternately beating the drum while the head rotates left and right and a melody is playing.

SUMMARY OF THE INVENTION

This invention relates to a person with a drum who alternately appears to be beating the drum with his left and right hands while a melody is playing. When his right hand moves upward, his head moves to the left. When his left hand moves upward, his head moves to the right.

An object of this invention is to provide a doll of a person with a drum that appears to be beating the drum alternately with his left and right hands while a melody is heard.

Another object of this invention to provide a doll of a boy with a drum whose head moves in the opposite direction of the upward movement of his hands.

A further object of this invention is to provide a doll of a boy with a drum that appears to be striking the drum alternately with his left and right hands while a melody is playing and his head is moving alternately in a left and right direction.

Other objects, features and advantages of the present invention will be readily apparent from the following detailed description taken in conjunction with the accompanying drawings.

DESCRIPTION OF THE PREFERRED EMBODIMENT

Figure 1:
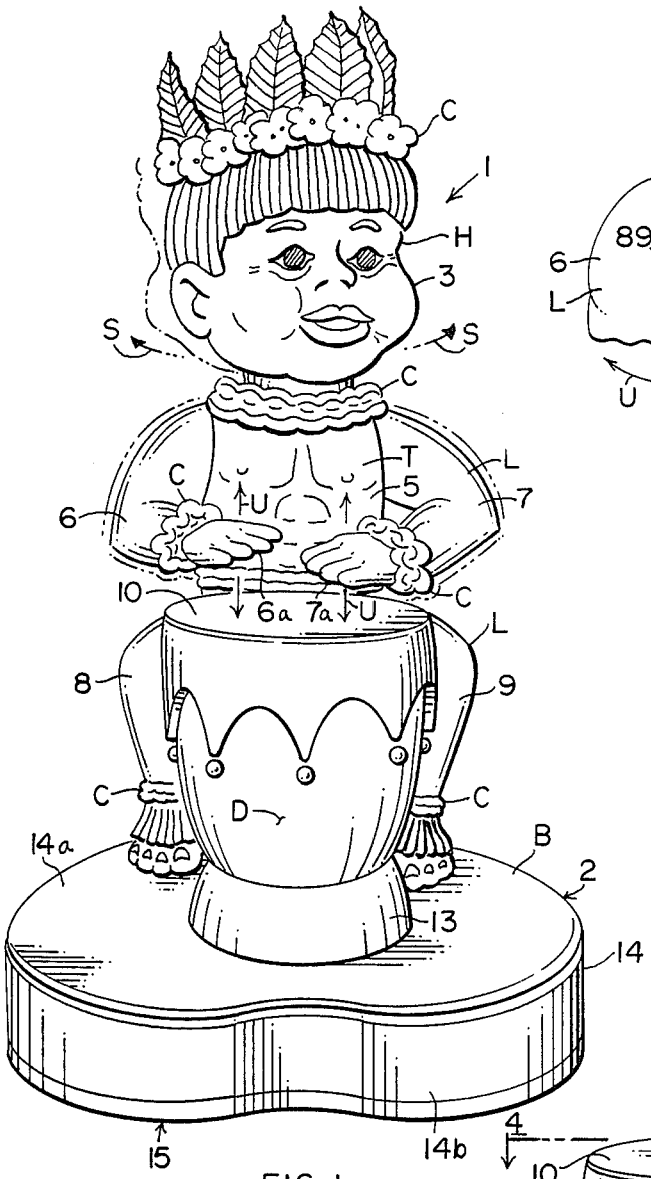
FIG. 1 is a front perspective view of the drum boy.
Figure 3:
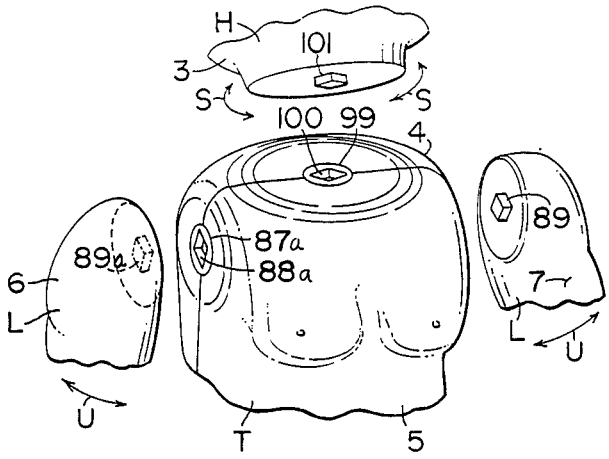
FIG. 3 is a fragmentary perspective view of torso, head, left and right arms showing the head and arm drive pins.
Figure 2:
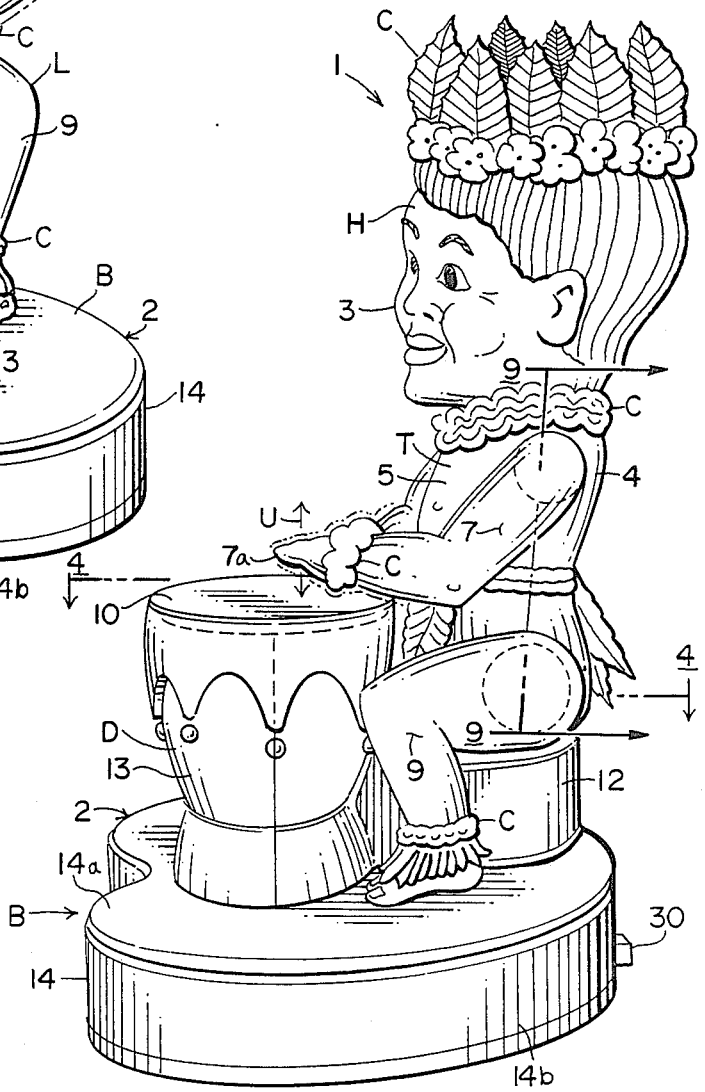
FIG. 2 is a left elevational view of the drum boy.
Figure 4:
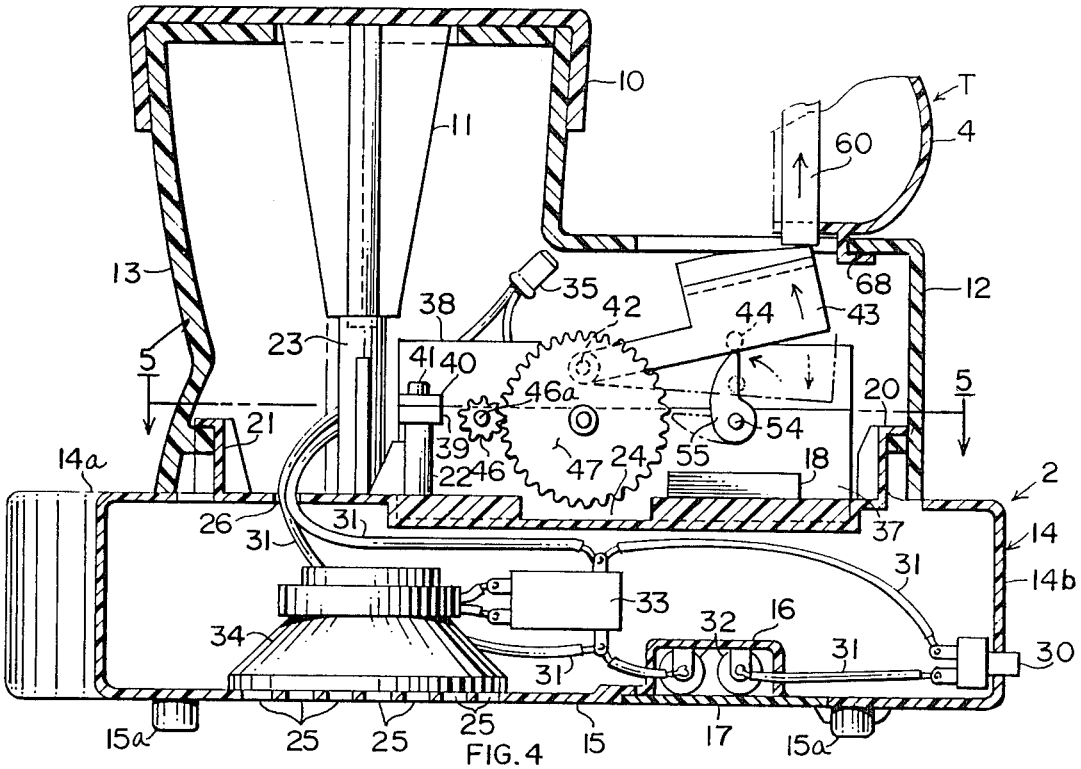
FIG. 4 is an enlarged fragmentary sectional view taken on line 4—4 of FIG. 2 showing base, motor drive, electronics, drum, and a portion of torso.
Figure 6:
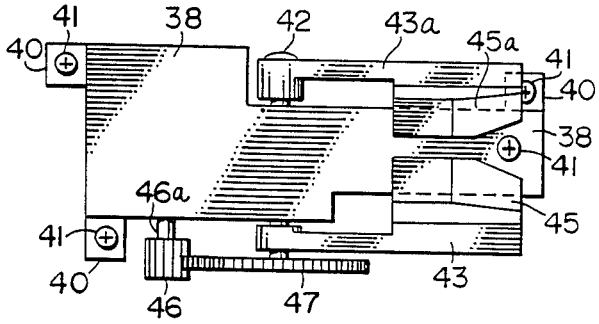
FIG. 6 is a plan view of the top of the motor drive and gear train box and left and right lifters.
Figure 7:
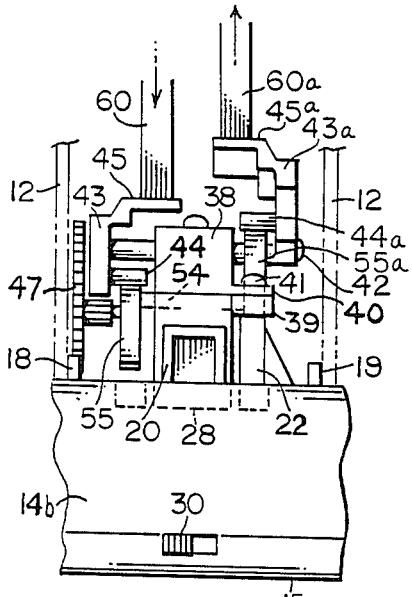
FIG. 7 is a fragmentary rear elevational view of motor gear box, cams, and lifters looking in the direction of line 7-7 of FIG. 5 showing the operation of the cams.
Figure 5:
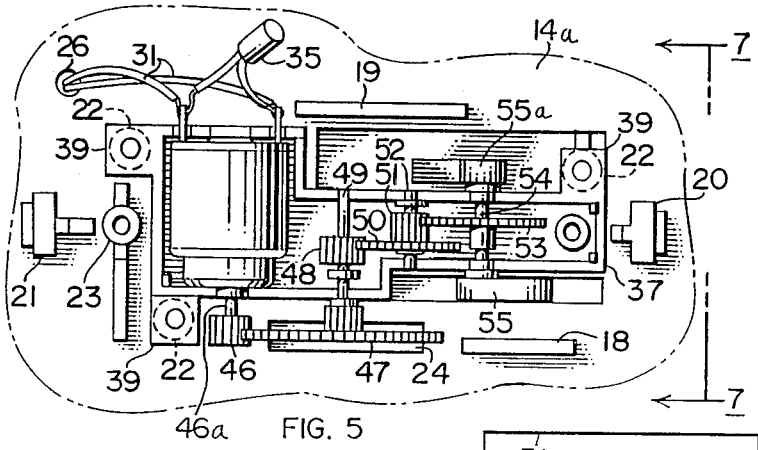
FIG. 5 is a plan view of motor drive unit with top of motor drive and gear train box removed.
Figure 8:
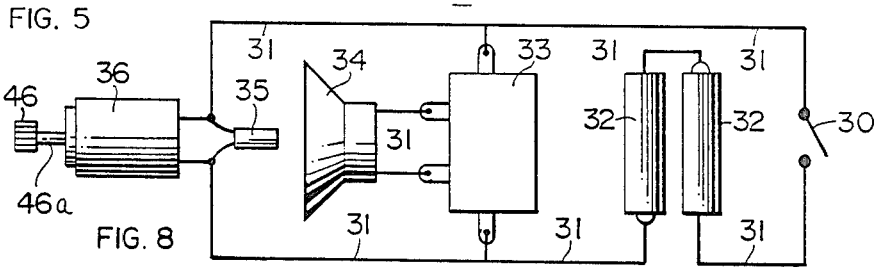
FIG. 8 is a plan view of wiring diagram of the drum boy.

Before explaining the present invention in detail it is to be understood that the invention is not limited in its application to the details of construction and arrangement of parts illustrated in the accompanying drawings, since the invention is capable of other embodiments and of being practiced or carried out in various ways. Also, it is to be understood that the phraseology or terminology employed herein is for the purpose of description and not limitation.

Referring now to the drawings wherein like reference numerals and letters refer to like and corresponding parts throughout the several views, the preferred embodiment of the invention disclosed in FIGS. 1-11 inclusive is a drum boy 1.

Drum boy 1 includes a head portion H, a torso portion T, a limbs portion L, a drum portion D, and a base portion B.

Head portion H includes head 3 and head drive pin 101.

Figure 9A:
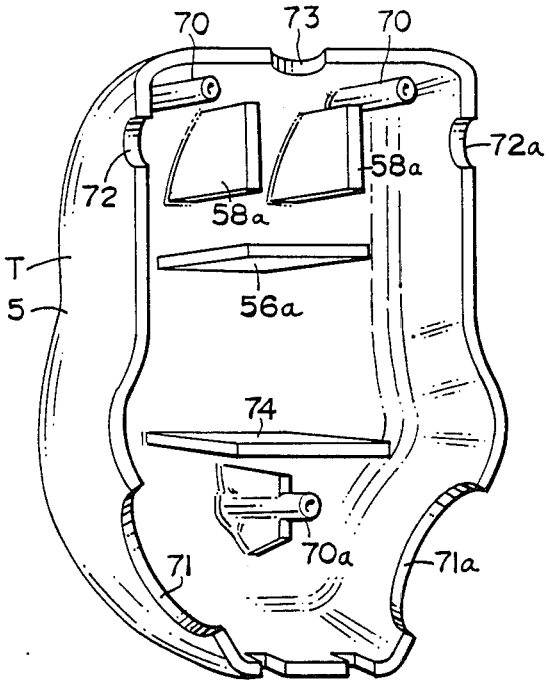
FIG. 9*a* is a rear elevational view of front-half of torso.
Figure 9:
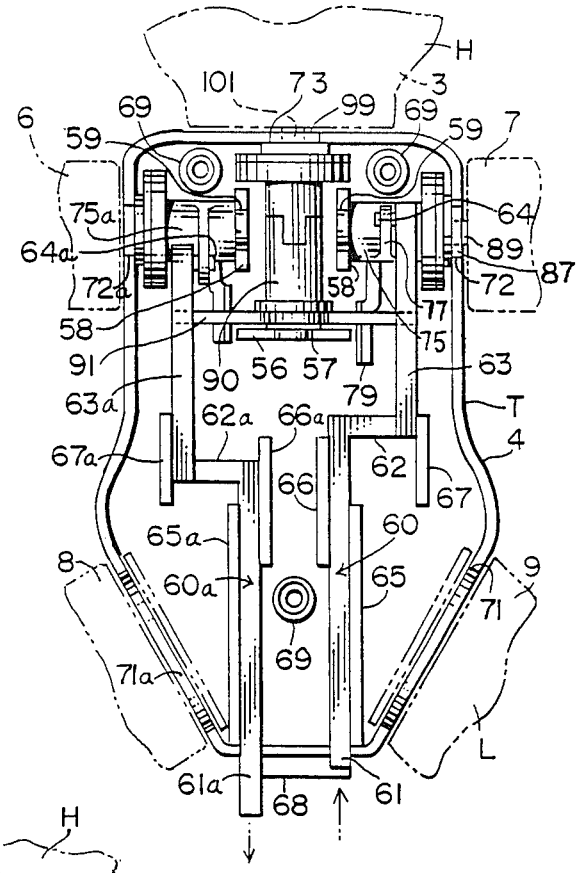
FIG. 9 is an enlarged fragmentary sectional view taken on line 9—9 of FIG. 2 showing the arm and head movement parts with the head and limbs in phantom.
Figure 11:
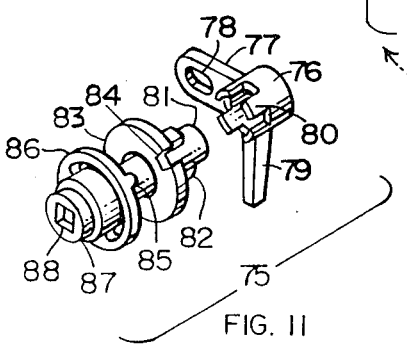
FIG. 11 is an exploded perspective of connector left arm assembly looking from left arm connection showing the relationship between the parts.
Figure 10:
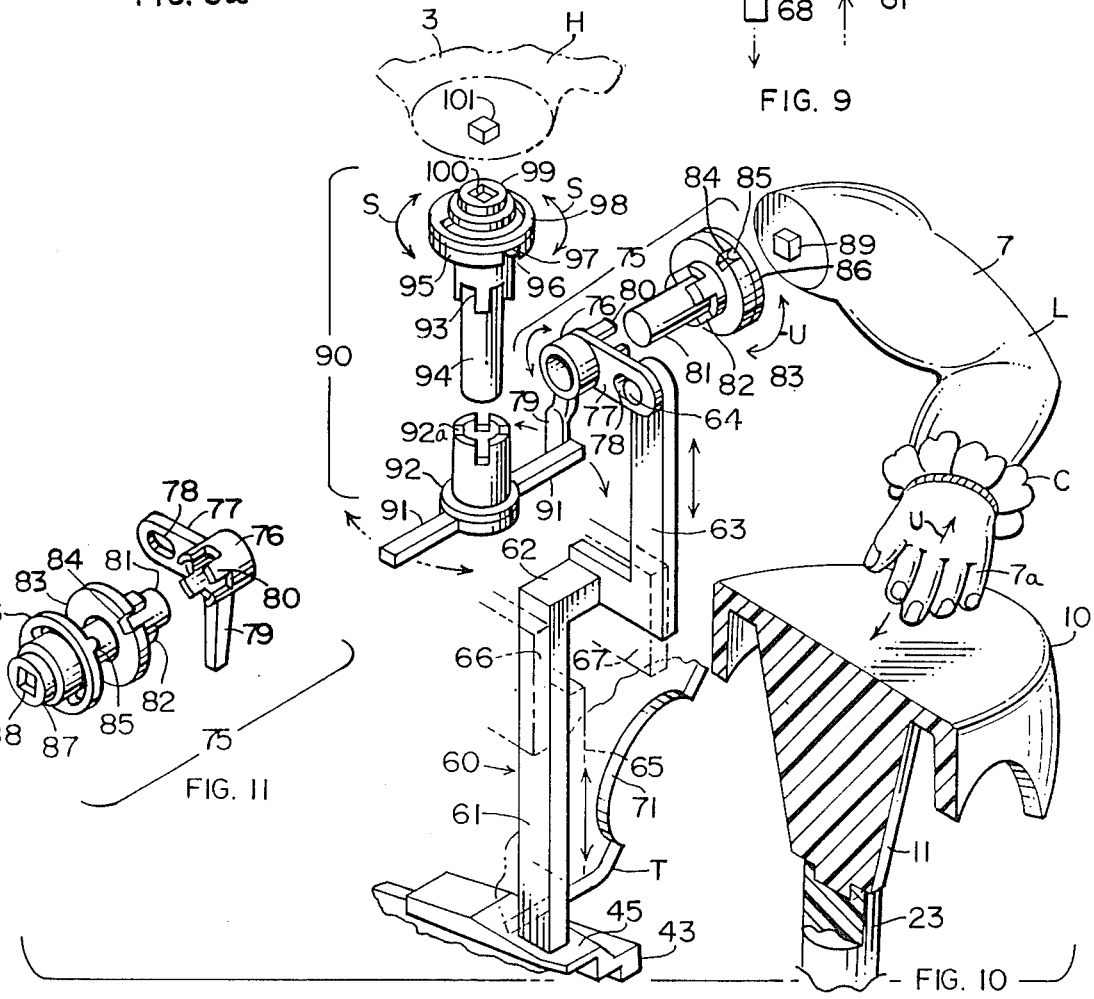
FIG. 10 is an exploded perspective of left arm and head movement parts and a fragmentary sectional view of drum.

Torso portion T is hollow and resembles a human body of a boy. It includes a front half 5, a rear half 4, locking tab 68, two push rods 60 and 60*a*, two long guides 65 and 65*a*, two medium guides 66 and 66*a*, two short guides 67 and 67*a*, three support posts 69, two leg recesses 71 and 71*a*, two arm recesses 72 and 72*a*, a head recess 73, a support 56, a retainer 56*a*, a bearing recess 57, two supports 58 with bearing recesses 59, two retainers 58*a*, two support inserts 70, one support insert 70*a*, a push rod keeper 74, two arm assemblies 75 and 75*a*, and a head swivel assembly 90. See FIGS. 9 and 9*a*.

Push rod 60 includes base 61, offset 62, shaft 63, and pin 64. Push rod 60*a* includes base 61*a*, offset 62*a*, shaft 63*a*, and pin 64*a*. See FIG. 9.

Left arm assembly 75 includes rocker piece 76 with actuator arm 77, an opening 78, push bar 79, and interlock 80, shaft 81 with collar 86, bearing 87, and arm drive hole 88 at one end, collar 83 with slot 84 and interlock 82. Collar 86 has a pin 85 at its perimeter which fits within slot 84. Right arm assembly 75*a* includes similar parts with "a" added to each reference numeral. See FIGS. 10 and 11 for left arm assembly 75.

Head swivel assembly 90 includes collar 92 with swivel bar 91 and interlock 92*a*; collar 95 with slot 96 and interlock 93; and shaft 94 with collar 98, bearing 99, and head drive hole 100 at one of its end. Collar 98 has a pin 97 at its perimeter which fits within slot 96. See FIG. 10.

Limbs portion L includes right arm 6 with right arm 6*a* and arm drive pin 89*a*, left arm 7 with left hand 7*a* and arm drive pin 89, right leg 8, and left leg 9. See FIGS. 1-3.

Drum portion D includes drum top 10, drum head post 11, back half of drum and seat 12, front half of drum 13, and drum post 23. See FIG. 4.

Base portion B includes housing 14 with top 14*a* and sides 14*b*, bottom 15 and four feet 15*a*, battery compartment 16, battery door 17, speaker holes 25, switch 30, wiring 31, batteries 32, I. C. Electronic Melody Circuit or melody module 33, and speaker 34. See FIG. 4. The I. C. Electronic Melody Circuit or melody module 33 provides a Hawaiian melody. But any melody which is appropriate with costume C worn may be used.

On or adjacent to top 14*a* are short guide 18, long guide 19, rear recess holder 20, front recess holder 21, three gear box mount posts 22, drum post 23, gear hole 24, wiring hole 26, gear box well 28, motor starter module 35, motor 36, motor drive and gear train box 37, cover of motor drive and gear train box 38, three bottom screw tabs 39, three top screw tabs 40, four screws 41, shaft pin 42, left lifter 43, right lifter 43*a*, left cam 55 with pin 44, right cam 55*a* with pin 44*a*, left lifting base 45, right lifting base 45*a*, drive gear 46, gears 47, 48, 50, 51, and 53, and shafts 46*a*, 49, 52, and 54. See FIGS. 4–7.

Reference letter S designates side to side motion with arrows to show direction of movement. Reference letter U designates up and down motion with arrows to show direction of movement. Arrows in the vicinity of the arms or hands show direction of movement of the arms or hands, respectively. Reference letter C designates costume.

The operation of my invention is as follows: When power is turned by switch 30, a Hawaiian melody is heard and motor 36 is activated. Motor 36 turns drive gear 46. Drive gear 46 turns gear 47 which then turns gears 48, 50, and 51. Gear 51 then turns gear 53. Gear 53 turns shaft 54 which in then rotates left cam 55 and right cam 55*a*. Left cam 55 rotates counterclockwise and right cam 55*a* rotates clockwise. Left cam 55 and right cam 55*a* are made to rotate at 180 degrees out of phase with each other.

Left cam 55 pushes pin 44 upward which causes lifter 43 to move upward. The upward movement of lifter 43 causes left push rod 60 to move upward which in turn causes left arm 7 to move upward and head 3 to move to the right. When the rotation of left cam 55 allows lifter 43 to move downward, left push rod 60 moves downward causing left arm 7 to move downward and appear to beat the drum. Lifter 43 makes a beating sound at the same time that left hand 7*a* appears to be beating the drum.

Right cam 55*a* pushes pin 44*a* upward which causes lifter 43*a* to move upward when lifter 43 is moving downward. The upward movement of lifter 43*a* causes right push rod 60*a* to move upward which in turn causes right arm 6 to move upward and head 3 to move to the left. When the rotation of right cam 55*a* allows lifter 43*a* to move downward, right push rod 60*a* moves downward causing right arm 6 to move downward and appear to beat the drum. Lifter 43*a* makes a beating sound at the same time that right hand 6*a* appears to be beating the drum.

When push rod 60 is moved upward by lifter 43, it causes rocker piece 76 to rotate clockwise. The rotation of rocker piece 76 causes the clockwise rotation of collar 87, bearing 87, and arm drive hole 88 and push bar 79. The rotation of arm drive hole 88 causes left arm 7 to move upward. The rotation of push bar 79 causes swivel bar 91 to rotate counterclockwise or forward. The rotation of swivel bar 91 causes the clockwise rotation of collar 98, bearing 99, and head drive hole 100. The rotation of head drive hole 100 causes head 3 to rotate to clockwise or to the right.

Similarly when push rod 60*a* is moved upward by lifter 43*a*, it causes rocker piece 76*a* to rotate counterclockwise. The rotation of rocker piece 76*a* causes the counterclockwise rotation of collar 87*a*, bearing 87*a*, and arm drive hole 88*a* and push bar 79*a*. The rotation of arm drive hole 88*a* causes right arm 6 to move upward. The rotation of push bar 79*a* causes swivel bar 91 to rotate clockwise or forward. The rotation of swivel bar 91 causes the counterclockwise rotation of collar 98, bearing 99, and head drive hole 100. The rotation of head drive hole 100 causes head 3 to rotate counterclockwise or to the left.

Thus when the left hand moves upward, the head moves to the right, and the right hand moves downward; and when the right hand moves upward, the head moves to the left, and the left hand moves downward.

My invention is a doll of a person with a drum that is lifelike because the hands appear to be alternately beating the drum while the head rotates left and right and a Hawaiian melody is playing. When his right hand moves upward, his head moves to the left. When his left hand moves upward, his head moves to the right. Moreover, for added realism, there is a drum beating sound when the hands appear to be beating the drum.

Although but a single embodiment of the invention has been disclosed and described herein, it is obvious that many changs may be made in the size, shape, arrangements, color and detail of the various elements of the invention without departing from the scope of the novel concepts of the present invention.

I claim as my invention:

1. A drum boy comprising: a head portion, a torso portion, a limbs portion, a drum portion, and a base portion; the head portion includes a head which resembles a human and a head drive pin; the torso portion is hollow and resembles the body of a human; the limbs portions includes a right arm, a right hand, a left arm, a left hand, a right leg, and a left leg; the head is pivotally connected to the top of the torso portion, the right arm and the left arm are pivotally connected to the sides of the torso portion, and the right leg and the left leg are connected to the sides of the torso portion; the drum portion includes a drum with a seat at its rear; the bottom of the torso portion is secured to the seat; the base portion includes a housing with feet on its bottom; the drum portion is secured to the top of the housing; means to alternately raise and lower the hands in sequence and to alternately rotate the head left and right a predetermined distance include a motor, gearing, wiring connecting the motor to a power source, two spaced cams, two spaced lifters, two spaced push rods, two spaced arm assemblies, a head swivel assembly, the motion of the motor is transmitted to said gearing which is connected to the two spaced cams that when rotated engage said two spaced lifters and push them upward into contact with said two spaced push rods that are connected to the two spaced arm assemblies that are connected to said head swivel assembly that when rotated causes the heat to rotate left and right, the lifters are operatively located above the cams and the push rods are operatively located above the lifters; each of the arm assemblies is operatively connected to one of the push rods; and the head swivel assembly is operatively connected to the arm assemblies.

2. The drum boy of claim 1, wherein there is a switch, a melody module, a speaker, and a battery compartment within the housing; the switch is secured to the side of the housing; wires connect the switch, the melody module, and the speaker to the power source.

3. The drum boy of claim 2, wherein the gearing that transmits the motion of the motor to the cams include a drive gear that is connected to a shaft of the motor, two spaced gears on a shaft, two gears on a second shaft, and a gear on a shaft that connects the cams; the drive gear meshes with one of the spaced gears; the other spaced gear meshes with one of the two gears on the second shaft; and the other gear on the second shaft meshes with the gear on the shaft that connects the cams.

4. A drum boy doll comprising: a head, a body being hollow and resembling the torso of a human, a right arm, a left arm, a right hand, a left hand, a right leg, a left leg, a drum, and a base portion; the head is pivotally connected to the top of the body, the right arm and left arm are pivotally connected to the sides of the body, and the right leg and the left leg are connected to the sides of the body; the drum is located on the top of the base portion and in front of the body; means to alternately raise and lower the hands and to alternately rotate the head horizontally including drive means, two spaced cams, and two spaced lifters located within said drum and activating means located in said body; the drive means are operatively connected to the two spaced cams; one end of the spaced lifters engage said activating means when moved by one of said cams; and said drive means, when activated, rotate the cams which in turn move the lifters to engage the activating means, causing the alternate raising and lowering of the hands and the alternate horizontal rotation of the head.

5. The drum boy doll of claim 4, wherein the base portion includes a housing with feet on its bottom; there is a switch, a melody module, a speaker, and a battery compartment within the housing; the switch is secured to the side of the housing; and wires connect the switch, the melody module, and the speaker to a power source.

* * * * *